US011511306B2

(12) United States Patent
Grünke et al.

(10) Patent No.: US 11,511,306 B2
(45) Date of Patent: Nov. 29, 2022

(54) DEVICE FOR LACQUER TRANSFER

(71) Applicants: Airbus Operations GmbH, Hamburg (DE); Airbus (SAS), Blagnac (FR)

(72) Inventors: Silke Grünke, Bremen (DE); Alexander Gillessen, Stade (DE); Pierre Zahlen, Stade (DE); Christian Schepp, Hamburg (DE); Daniel Kress, Hamburg (DE); Waldemar Kümmel, Hamburg (DE)

(73) Assignees: AIRBUS OPERATIONS GmbH, Hamburg (DE); AIRBUS (SAS), Blagnac (FR)

( * ) Notice: Subject to any disclaimer, the term of this patent is extended or adjusted under 35 U.S.C. 154(b) by 140 days.

(21) Appl. No.: 16/868,997

(22) Filed: May 7, 2020

(65) Prior Publication Data

US 2020/0353499 A1 Nov. 12, 2020

(30) Foreign Application Priority Data

May 8, 2019 (DE) ..... 102019111982.0

(51) Int. Cl.
*B05C 1/08* (2006.01)
*B05D 1/28* (2006.01)
(Continued)

(52) U.S. Cl.
CPC ..... *B05C 1/0834* (2013.01); *B05C 9/14* (2013.01); *B05D 1/28* (2013.01); *B05D 3/0413* (2013.01); *B05D 3/067* (2013.01)

(58) Field of Classification Search
None
See application file for complete search history.

(56) References Cited

U.S. PATENT DOCUMENTS 9,314,811 B1 * 4/2016 Brophy ..... H01L 31/00
9,808,823 B2 * 11/2017 Pagendarm ..... B05C 1/0813
(Continued)

FOREIGN PATENT DOCUMENTS

| | | |
|---|---|---|
| CN | 103722917 | 4/2014 |
| EP | 2 206 606 | 7/2010 |
| WO | 2015/155128 | 10/2015 |

OTHER PUBLICATIONS

German Search Report for German Application No. 10 2019 111 982.0 dated Feb. 13, 2020, 7 pages.

*Primary Examiner* — Jethro M. Pence
(74) *Attorney, Agent, or Firm* — Nixon & Vanderhye P.C.

(57) ABSTRACT

A device for lacquer transfer is disclosed having a frame, a nozzle with a dispensing end for dispensing lacquer, and a transfer roller with a circumferential lateral wall, a circumferential outer contact surface of the lateral wall comprises several depressions, wherein the nozzle and the transfer roller are arranged such that lacquer is dispensable from the dispensing end onto the outer contact surface and into the depressions, wherein the transfer roller is configured to roll with the outer contact surface on a work surface of a workpiece for transferring the lacquer from the outer contact surface and from the depressions to the work surface of the workpiece. A first hardening unit is formed as a UV-light unit configured for partially hardening the lacquer in a contactless way by emitting UV-light, the first hardening unit is arranged within an interior space defined by the transfer roller. The lateral wall of the transfer roller is transparent for UV-light, and the first hardening unit is arranged such that UV-light is emittable towards the work surface in a first operational area of the work surface to partially harden the lacquer in the first operational area.

9 Claims, 2 Drawing Sheets

(51) Int. Cl.

| | |
|---|---|
| ***B05D 3/04*** | (2006.01) |
| ***B05D 3/06*** | (2006.01) |
| ***B05C 9/14*** | (2006.01) |

(56) References Cited

U.S. PATENT DOCUMENTS

| | | | |
|---|---|---|---|
| 2006/0066703 | A1 | 3/2006 | Kadomatsu et al. |
| 2015/0251409 | A1 | 9/2015 | Ohnishi |

* cited by examiner

DEVICE FOR LACQUER TRANSFER

CROSS REFERENCE TO RELATED APPLICATION

This application claims priority to and incorporates by reference German Application Number DE 10 2019 111 982.0, filed May 8, 2019.

BACKGROUND

The present disclosure relates to a device for a lacquer transfer.

A device for a lacquer transfer is known from the publication WO 2015/155 128 A1. This publication discloses a device which is configured for transferring lacquer to a work surface. The device comprises a frame, a transfer roller with a circumferential outer contact surface with several depressions and a drive unit. The transfer roller is mounted rotatably about an axis of rotation at the frame. The drive unit is configured to drive rotation of the transfer roller about the axis of rotation. The device can be connected to a robot arm and moved via the robot arm in parallel to the work surface, such that the transfer roller rolls with its outer contact surface on the work surface for transferring lacquer from the outer contact surface, and in particular from the depressions, to the work surface. Before the outer contact surface or lacquer on the outer contact surface comes into contact with the work surface, the lacquer has to be dispensed onto the outer contact surface and into the depressions, such that the lacquer can be transferred subsequently to the work surface, especially as a lacquer film, while the transfer roller rolls on the work surface.

Preferably, the lacquer of the lacquer film fills the depressions and the lacquer film extends in the axial direction and partly in the circumferential direction of the transfer roller. The lacquer film may be integrally formed of several sections, of which one section may be a depression section, which fills the depressions, and a remaining section, which is also referred to as bulk or bulk part. The transfer roller may be configured to roll with the outer contact surface of the transfer roller on the work surface of the work piece for transferring lacquer from the outer contact surface and from the depressions to the work surface of the work piece, such that the lacquer film is transferred to the work surface. The transfer of the lacquer film to the work surface may comprise a transfer of the lacquer from the depressions to the work surface as well as a transfer of the bulk part to the work surface.

During transfer of the lacquer from the outer contact surface, and in particular from the depressions, to the work surface, it is desirable that the lacquer exhibits a certain degree of dimensional stability such that the depression section of the lacquer film retains its shape while being transferred to the work surface. Further, it is desirable that the lacquer adheres to the work surface such that the lacquer separates from the outer contact surface and from the depressions such that the lacquer can be reliably transferred to the work surface.

SUMMARY

The disclosure provides a device, which is configured for reliably transferring lacquer via a transfer roller to a work surface of a work piece as a lacquer film with a depression section.

According to an exemplary embodiment, the object is solved by a device comprising the features of claim 1. The device is configured for lacquer transfer. The device comprises a frame, a drive unit, a nozzle with a dispensing end for dispensing lacquer, a transfer roller with a circumferential lateral wall, and at least two hardening units. The nozzle and each hardening unit of the at least two hardening units are each at least indirectly connected to the frame. The transfer roller is rotatably mounted on the frame, such that the transfer roller is rotatable relative to the frame about an axis of rotation. The drive unit is configured to drive rotation of the transfer roller about the axis of rotation. A circumferential outer contact surface of the lateral wall comprises several depressions. The nozzle and the transfer roller are arranged such that lacquer is dispensable from the dispensing end onto the outer contact surface and into the depressions when the transfer roller rotates about the axis of rotation. The transfer roller is configured to roll with the outer contact surface on a work surface of a workpiece for transferring the lacquer from the outer contact surface and from the depressions to the work surface of the workpiece along a rolling direction. A first hardening unit of the at least two hardening units is formed as a UV-light unit configured for partially hardening the lacquer in a contactless way by emitting UV-light. The first hardening unit is arranged within an interior space defined by the transfer roller. The lateral wall of the transfer roller is transparent for UV-light. The first hardening unit is arranged such that UV-light is emittable towards the work surface in a first operational area of the work surface to partially harden the lacquer in the first operational area. The lacquer is transferable to the work surface in the first operational area. A second hardening unit of the at least two hardening units is configured for at least partially hardening the lacquer in a contactless way. The second hardening unit is arranged such that the lacquer is at least partially hardenable by the second hardening unit in a second operational area of the work surface in which the lacquer was transferred to the work surface and was partially hardened by the first hardening unit.

The device comprises the frame. The frame may be configured to be releasably connected to a handling device, such as a robot. When the handling device is a robot, the frame may be releasably connected to a robot arm of the robot. The device may be moved translatorically in parallel to the work surface, preferably by the robot arm or another handling device, while the transfer roller rotates about the axis of rotation, such that the transfer roller rolls on the work surface for transferring lacquer onto the work surface.

The device comprises the drive unit. The drive unit may be directly or indirectly connected to the frame. The drive unit may be releasably connected to the frame. A releasable connection between the drive unit and the frame facilitates the exchange of the drive unit. The device may comprise connecting means for connecting the drive unit to the frame. The drive unit is configured to drive rotation of the transfer roller about the axis of rotation. The drive unit can drive rotation of the transfer roller about the axis of rotation when the device is in use such that the transfer roller rotates relative to the frame about the axis of rotation and rolls with the outer contact surface on the work surface.

The device comprises the nozzle with the dispensing end for dispensing lacquer. The nozzle may be directly or indirectly connected to the frame. The direct or indirect connection of the nozzle to the frame ensures that the nozzle is at least indirectly connected to the frame. The nozzle may be releasably connected to the frame. A releasable connection between the nozzle and the frame facilitates the exchange of the nozzle. The device may comprise connecting means for connecting the nozzle to the frame. The nozzle may be disconnected form the frame, in particular for maintenance purposes. The nozzle may be automatically disconnected from the frame. Further, the nozzle may be automatically connected and/or reconnected to the frame. The nozzle may be connected to the frame, such that the nozzle can be releasably locked in a working position. If this lock is released, the nozzle may be pivoted from the working position in a non-working position via a hinge, which may hold the nozzle at the frame. The nozzle may be serviced in the non-working position. The nozzle may be automatically pivoted from the working position to the non-working position as well as from the non-working position to the working position via the hinge.

The device comprises the transfer roller with a circumferential lateral wall. The transfer roller is rotatably mounted on the frame. The rotatable mounting on the frame of the transfer roller allows the transfer roller to rotate relative to the frame about the axis of rotation. The drive unit is configured to drive rotation of the transfer roller such that the transfer roller rotates about the axis of rotation. The lateral wall may extend annularly around a cylindrical support body of the transfer roller. The lateral wall may be elastically deformable. The elastic deformability of the lateral wall ensures that the lateral wall can be brought from an undeformed state to an elastically deformed state, when a force acts on the lateral wall, and that the tire can be brought from the elastically deformed state back to the undeformed state when the force does not act on the lateral wall anymore. The lateral wall may have a lower stiffness than the stiffness of the support body. To provide the lateral wall with a low stiffness, the lateral wall may be formed of an elastomer, especially of silicone. For example, the Young's modulus of the lateral wall is at most 10 GPa. The lateral wall may deform when the transfer roller rolls with the outer contract surface on the work surface such that the outer contact surface adapts its shape in a contact patch section of the lateral wall to the shape of the work surface.

The device comprises at least two hardening units. Each hardening unit of the at least two hardening units may be directly or indirectly connected to the frame. The direct or indirect connection of each hardening unit to the frame ensures that each hardening unit is at least indirectly connected to the frame.

A circumferential outer contact surface of the lateral wall comprises several depressions. The outer contact surface preferably faces in a radial direction of the transfer roller. Each of the depressions can receive lacquer from the dispensing end of the nozzle and release lacquer to the work surface of the workpiece. The nozzle and the transfer roller are arranged such that lacquer is dispensable from the dispensing end into the depressions. When lacquer is dispensed from the dispensing end into the depressions, the lacquer can later be released from the depressions and to the work surface of the workpiece. The depressions may be evenly distributed about the outer contact surface. The depressions can be formed by recesses arranged at the outer contact surface. The depressions can have a predefined size and/or structure. A mean structure size of the depressions can be in the range of 0.1 micrometer to 1000 micrometer. Each of the depressions can be open towards a surrounding of the transfer roller in the radial direction and closed towards the interior space defined by the transfer roller.

The nozzle and the transfer roller are arranged such that lacquer is dispensable from the dispensing end onto the outer contact surface and into the depressions when the transfer roller rotates about the axis of rotation. In particular, a lacquer film is dispensable from the dispensing end onto the outer contact surface and into the depressions. The lacquer of the lacquer film may fill the depressions and the lacquer film extends in the axial direction and partly in the circumferential direction of the transfer roller. The lacquer film may be integrally formed of several sections, of which one section may be a depression section, which fills the depressions, and a remaining section, which is also referred to as bulk or bulk part. The transfer roller may be configured to roll with the outer contact surface of the transfer roller on the work surface of the work piece for transferring lacquer from the outer contact surface and from the depressions to the work surface of the work piece, such that the lacquer film is transferred to the work surface. The transfer of the lacquer film to the work surface may comprise a transfer of the lacquer from the depressions to the work surface as well as a transfer of the bulk part to the work surface. If the transfer of the lacquer from the depressions to the work surface is described with regard to the present invention, the transfer of the lacquer from the depressions to the work surface may comprise the possible transfer of the bulk part to the work surface and/or the possible transfer of the lacquer from the depressions on top of the bulk part on the work surface.

The transfer roller is configured to roll with the outer contact surface on the work surface of the workpiece. This configuration of the transfer roller allows the transfer of lacquer from the outer contact surface and from the depressions to the work surface of the workpiece. The transfer roller is configured to roll along the rolling direction. Transfer roller may roll parallel to an extension of the work surface when the transfer roller rolls along the rolling direction. When lacquer is received by the depressions of the outer contact surface and the transfer roller rolls with the outer contact surface on the work surface of the workpiece along the rolling direction, the lacquer can be transferred from the depressions to the work surface.

A first hardening unit of the at least two hardening units is formed as a UV-light unit configured for partially hardening the lacquer in a contactless way by emitting UV-light. The first hardening unit is arranged within an interior space defined by the transfer roller. The lateral wall of the transfer roller is transparent for UV-light. UV-light emitted by the first hardening unit can transmit through the lateral wall of the transfer roller and to the work surface. The first hardening unit is arranged such that UV-light is emittable towards the work surface in a first operational area of the work surface to partially harden the lacquer in the first operational area. In the first operational area, lacquer can be transferred to the work surface. The lacquer is only partially hardened by the first hardening unit in the first operational area. A section of the lacquer can be partially hardened during a time interval, in which the section of the lacquer is initially on the outer contact surface and in the depressions, then on the outer contact surface and in the depressions as well as on the work surface, and finally on the work surface as a transferred section of the lacquer. The partially hardened lacquer in the first operational area exhibits a certain degree of dimensional stability such that the depression section of the lacquer film retains its shape while and after being transferred to the work surface. Further, the only partially hardened lacquer, especially the bulk section of the lacquer film, exhibits enough flexibility to plastically deform to adapt to the shape of the work surface. Further, the partially hardened lacquer can adhere to the work surface such that strong adhesive forces act between the work surface and the lacquer such that the lacquer is released from the outer contact surface and from the depressions.

A second hardening unit of the at least two hardening units is configured for at least partially hardening the lacquer in a contactless way. The second hardening unit is arranged such that the lacquer is at least partially hardenable by the second hardening unit in a second operational area of the work surface in which the lacquer was transferred to the work surface and was partially hardened by the first hardening unit. The lacquer is at least partially hardened by the second hardening unit in the second operational area such that the lacquer is partially or fully hardened by the second hardening unit in the second operational area. Due to the second hardening unit, the lacquer does not need to be fully hardened by the first hardening unit.

Therefore, the lacquer is hardened in two consecutive steps. In a first step, the lacquer is partially hardened by the first hardening unit, which may also be called prehardening or precuring of the lacquer. In a second step, the lacquer is at least partially hardened by the second hardening unit, which may also be called posthardening or postcuring. The prehardening of the lacquer ensures that the lacquer exhibits a certain degree of dimensional stability, but still enough flexibility, and can adhere to the work surface. The posthardening of the lacquer ensures that the lacquer is further hardened such that finally a fully hardened lacquer on the work surface can be provided with the help of the second hardening unit or with the help of the second hardening unit and further hardening units of the at least two hardening units.

In summary, a device is provided which is configured for reliably transferring lacquer via a transfer roller to a work surface of a work piece as a lacquer film with a depression section.

According to an exemplary embodiment of the device, the second hardening unit is formed as a UV-light unit configured for at least partially hardening the lacquer in a contactless way by emitting UV-light, wherein the second hardening unit is arranged such that UV-light is emittable towards the work surface in the second operational area of the work surface to at least partially harden the lacquer in the second operational area. When the second hardening unit is formed as a UV-light unit, the lacquer can be hardened in two consecutive steps by UV-light.

According to an exemplary embodiment of the device, the second hardening unit is formed as an IR-light unit configured for at least partially hardening the lacquer in a contactless way by emitting IR-light, wherein the second hardening unit is arranged such that IR-light is emittable towards the work surface in the second operational area of the work surface to at least partially harden the lacquer in the second operational area. When the second hardening unit is formed as an IR-light unit, the lacquer can be hardened by UV-light and IR-light in two consecutive steps. UV-light within the meaning of the present invention is any kind of UV-radiation. Similarly, IR-light within the meaning of the present invention is any kind of IR-radiation.

According to an exemplary embodiment of the device, the second hardening unit is formed as a fan heater unit configured for at least partially hardening the lacquer in a contactless way by emitting heated air, wherein the second hardening unit is arranged such that heated air is emittable towards the work surface in the second operational area of the work surface to at least partially harden the lacquer in the second operational area. When the second hardening unit is formed as a fan heater unit, the lacquer can be hardened by UV-light and heated air in two consecutive steps.

According to an exemplary embodiment of the device, the device comprises a shield, wherein the shield is at least indirectly connected to the frame and extends away from the frame towards a distal end of an end section of the shield, wherein the shield is arranged between the first hardening unit and the second hardening unit such that the second operational area is shielded from the UV-light emitted from the first hardening unit. The shield ensures that the first hardening unit only hardens the lacquer in the first operational area and that UV-light emitted from the first hardening unit does not harden the lacquer in the second operational area. Therefore, the second hardening unit can harden the lacquer in the second operational area without interaction of the UV-light emitted from the first hardening unit. The shield can also be regarded as a light shield.

As mentioned before, the second hardening unit may be formed as a UV-light unit, as an IR-light unit, or as a fan heater. In case the second hardening unit is formed as a UV-light unit the shield may be arranged between the first hardening unit and the second hardening unit such that the first operational area is shielded from the UV-light emitted from the second hardening unit. In this case the shield ensures that the second hardening unit only hardens the lacquer in the second operational area and that UV-light emitted from the second hardening unit does not harden the lacquer in the first operational area. Therefore, the first hardening unit can harden the lacquer in the first operational area without interaction of the UV-light emitted from the second hardening unit. Similarly, in case the second hardening unit is formed as an IR-light unit, the shield may be arranged between the first hardening unit and the second hardening unit such that the first operational area is shielded from the IR-light emitted from the second hardening unit. In this case the shield ensures that the second hardening unit only hardens the lacquer in the second operational area and that IR-light emitted from the second hardening unit does not harden the lacquer in the first operational area. Therefore, the first hardening unit can harden the lacquer in the first operational area without interaction of the IR-light emitted from the second hardening unit. Likewise, in case the second hardening unit is formed as a fan heater, the shield may be arranged between the first hardening unit and the second hardening unit such that the first operational area is shielded from the heated air emitted from the second hardening unit. In this case, the shield ensures that the second hardening unit only hardens the lacquer in the second operational area and that heated air emitted from the second hardening unit does not harden the lacquer in the first operational area. Therefore, the first hardening unit can harden the lacquer in the first operational area without interaction of heated air emitted from the second hardening unit.

According to an exemplary embodiment of the device, the distal end of the end section of the shield is arranged at a predefined distance from the work surface when the transfer roller rolls with the outer contact surface on the work surface. The predefined distance between the distal end and the work surface allows the transfer roller to roll over the work surface such that the shield can move along the rolling direction over the transferred lacquer at a distance from the lacquer.

According to an exemplary embodiment of the device, the end section of the shield is flexible such that the end section is elastically deformable against the rolling direction. The flexibility of the end section ensures that the end section can adapt its shape when the end section comes into contact with the transferred lacquer while the shield moves along the rolling direction over the transferred lacquer. Therefore, the flexibility of the end section ensures that the shape of the prehardened lacquer is maintained even when the end section comes into contact with the transferred lacquer.

According to an exemplary embodiment of the device, the device comprises a third hardening unit of the at least two hardening units, wherein the third hardening unit is configured for at least partially hardening the lacquer in a contactless way, wherein the third hardening unit is arranged such that the lacquer is at least partially hardenable by the third hardening unit in a third operational area of the work surface in which the lacquer was transferred to the work surface and was partially hardened by the first hardening unit and by the second hardening unit. The lacquer can be partially hardened or fully hardened by the third hardening unit. Due to the third hardening unit, the second hardening unit does not need to fully harden the lacquer. The third hardening unit may be formed as a UV-light unit, an IR-light unit or a fan heater unit. The features, technical effects and/or advantages described in connection with the first hardening unit and second hardening unit also apply to the third hardening unit and each further hardening unit of the at least two hardening units at least in an analogous manner, so that no corresponding repetition is made here.

As mentioned before, the third hardening unit may be formed as a UV-light unit, as an IR-light unit or as a fan heater unit. In case the third hardening unit is formed as a UV-light unit, the shield may be arranged between the first hardening unit and the third hardening unit such that the first operational area is shielded from the UV-light emitted from the third hardening unit. In this case the shield ensures that the third hardening unit hardens the lacquer in the third operational area and that UV-light emitted from the third hardening unit does not harden the lacquer in the first operational area. Therefore, the first hardening unit can harden the lacquer in the first operational area without interaction of the UV-light emitted from the third hardening unit. Similarly, in case the third hardening unit is formed as an IR-light unit, the shield may be arranged between the first hardening unit and the third hardening unit such that the first operational area is shielded from the IR-light emitted from the third hardening unit. In this case, the shield ensures that the third hardening unit hardens the lacquer in the third operational area and that IR-light emitted from the third hardening unit does not harden the lacquer in the first operational area. Therefore, the first hardening unit can harden the lacquer in the first operational area without interaction of the IR-light emitted from the third hardening unit. Likewise, in case the third hardening unit is formed as a fan heater, the shield may be arranged between the first hardening unit and the third hardening unit such that the first operational area is shielded from the heated air emitted from the third hardening unit. In this case, the shield ensures that the third hardening unit hardens the lacquer in the third operational area and that heated air emitted from the third hardening unit does not harden the lacquer in the first operational area. Therefore, the first hardening unit can harden the lacquer in the first operational area without interaction of heated air emitted from the third hardening unit.

The device may comprise a further shield, which may be configured similarly to the shield. The further shield may be arranged between the second hardening unit and the third hardening unit such that the third operational area is shielded from UV-light and/or IR-light and/or heated air emitted from the second hardening unit and/or such that such that the second operational area is shielded from UV-light and/or IR-light and/or heated air emitted from the third hardening unit.

According to an exemplary embodiment, the object is also solved by a method comprising the features of claim 9. The method is suitable for lacquer transfer using the device according to the first aspect of the present invention. The transfer roller rotates relative to the frame about the axis of rotation. The drive unit drives rotation of the transfer roller about the axis of rotation. Lacquer is dispensed from the dispensing end onto the outer contact surface and into the depressions. The transfer roller rolls with the outer contact surface on the work surface of the workpiece along the rolling direction such that the lacquer is transferred from the outer contact surface and from the depressions to the work surface in the first operational area of the work surface. The lacquer is partially hardened in the first operational area of the work surface by UV-light emitted from the first hardening unit towards the work surface in the first operational area. The lacquer is at least partially hardened in the second operational area of the work surface by the second hardening unit. The features, technical effects and/or advantages described in connection with the device according to the first aspect of the present invention also apply to the method according to the second aspect of the present invention at least in an analogous manner, so that no corresponding repetition is made here.

BRIEF DESCRIPTION OF THE DRAWINGS

Further features, advantages and application possibilities of the present invention may be derived from the following description of exemplary embodiments and/or the figures. Thereby, all described and/or visually depicted features for themselves and/or in any combination may form an advantageous subject matter and/or features of the present invention independent of their combination in the individual claims or their dependencies. Furthermore, in the figures, same reference signs may indicate same or similar objects.

In the accompanying drawings, like reference characters refer to the same or similar parts throughout the different views. The drawings are not necessarily to scale, emphasis instead being placed upon illustrating particular principles, discussed below.

DETAILED DESCRIPTION OF SOME EMBODIMENTS

Some embodiments will now be described with reference to the Figures.

Figure 1:
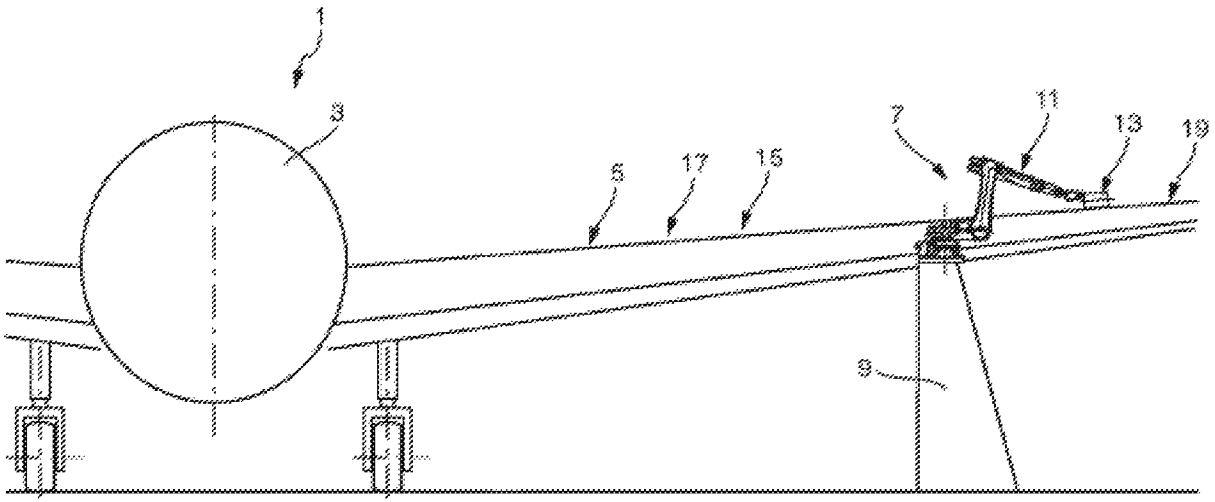
FIG. 1 schematically illustrates a part of an aircraft with a wing and an embodiment of a device for lacquer transfer onto an upper wing surface of the wing.

FIG. 1 schematically illustrates a part of an aircraft 1, which comprises a fuselage 3 and a wing 5. A robot 7 is seated on a rack 9. The robot 7 comprises a movable robot arm 11. A device 13 according to an embodiment of the present invention is mounted at an end of the robot arm 11, such that the device 13 can be moved by the robot 7. The device 13 is configured for transferring lacquer, which may by hardenable by UV-light and/or IR-light and/or heated air, onto a work surface 15 of a workpiece 17. According to the example shown in FIG. 1, the workpiece 17 can be formed by the wing 5 of the aircraft 1 and an upper wing surface 19 of the wing 5 can form the work surface 15.

Figure 2:
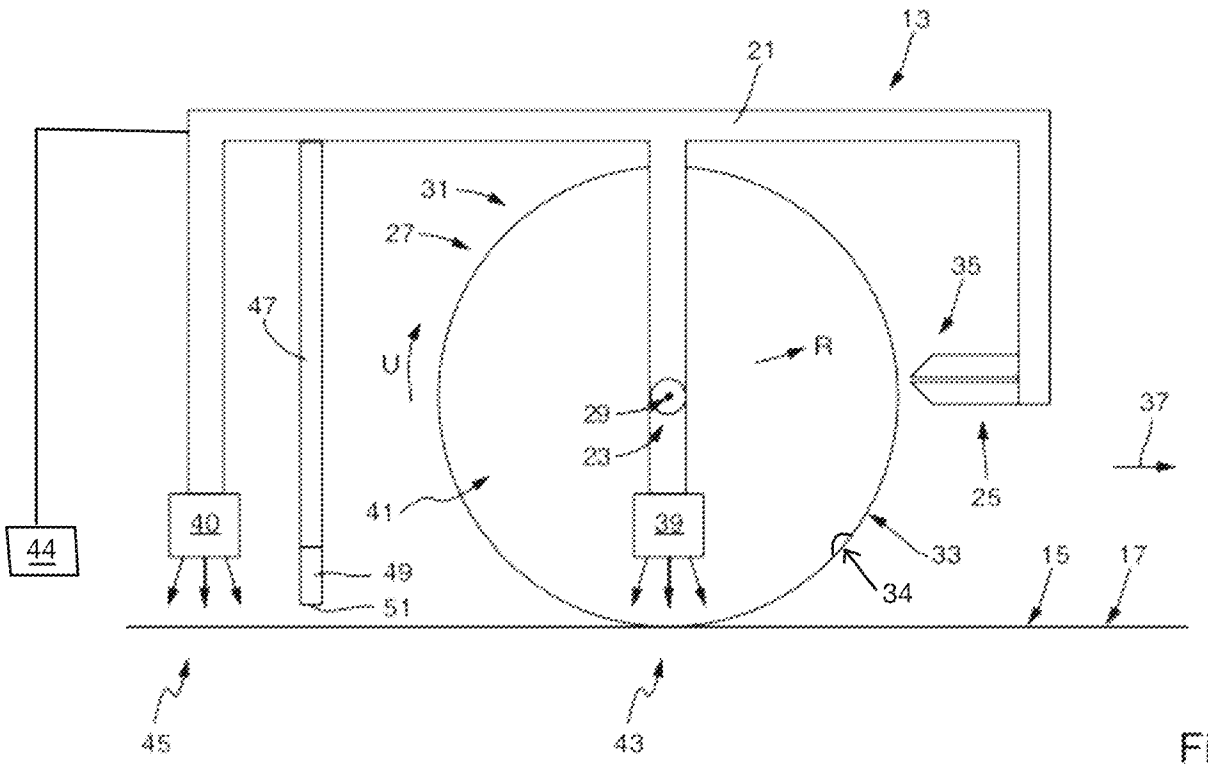
FIG. 2 schematically illustrates the embodiment of the device in FIG. 1 in a cross-sectional view.

FIG. 2 schematically illustrates the embodiment of the device 13 in FIG. 1 in a cross-sectional view. The device 13 comprises a frame 21, a drive unit 23, a nozzle 25, and a transfer roller 27. The device 13 can be attached via the frame 21 to the robot arm 11. However, instead of a robot 7 any other handling device may be used, which is configured to move the device 13 in space. The frame 21 may be adapted to be releasably connected to a handling device, such as the robot 7.

The transfer roller 27 is mounted rotatably, in particular by means of at least one bearing, about an axis of rotation 29 on the frame 21 such that the transfer roller 27 is rotatable about the axis of rotation 29 relative to the frame 21. The transfer roller 27 comprises a circumferential lateral wall 31, which is transparent for UV-light and may be elastically deformable, especially in and against a radial direction R. The lateral wall 31 comprises a circumferential outer contact surface 33 with several depressions 34. The nozzle 25, which is connected to the frame 21, comprises a dispensing end 35 for dispensing lacquer onto the outer contact surface 33 and into the depressions 34. The nozzle 25 and the transfer roller 27 are arranged such that lacquer is dispensable from the dispensing end 35 onto the outer contact surface 33 and into the depressions, especially when the transfer roller 27 rotates about the axis of rotation 29.

The drive unit 23 is configured to drive rotation of the transfer roller 27 about the axis of rotation 29, such that the tire 31 continuously rotates around the axis of rotation 29 when rotation of the transfer roller 27 is driven by the drive unit 23. When lacquer is dispensed from the dispensing end 35 of the nozzle 25 onto the outer contact surface 33 and into the depressions, the lacquer rotates around the axis of rotation 29 in a rotation direction U. When the lacquer reaches the work surface 15 of the workpiece 17, the lacquer is transferred from the depressions and from the outer contact surface 33 to the work surface 15. Therefore, the transfer roller 27 is configured to roll with the outer contact surface 33 on the work surface 15 of the workpiece 17 for transferring the lacquer from the outer contact surface 33 and from the depressions to the work surface 15 of the workpiece 17 along a rolling direction 37.

The device 13 comprises a first hardening unit 39 and a second hardening unit 40. The first hardening unit 39 and the second hardening unit 40 are each connected to the frame 21. The first hardening unit 39 is arranged within an interior space 41 defined by the transfer roller 27. The second hardening unit 40 is arranged outside of the interior space 41.

The first hardening unit 39 is formed as a UV-light unit configured for partially hardening the lacquer in a contactless way by emitting UV-light. The first hardening unit 39 is arranged such that UV-light is emittable towards the work surface 15 in a first operational area 43 of the work surface 15 to partially harden the lacquer in the first operational area 43. In the first operational area 43, the lacquer is transferred to the work surface 15. The device 13 may be configured to control the drive unit 23 and/or the first hardening unit 39 such that lacquer transferred to the work surface 15 is partially hardened via UV-light emitted by the first hardening unit 39.

The second hardening unit 40 is configured for at least partially hardening the lacquer in a contactless way. The second hardening unit 40 is arranged such that the lacquer is at least partially hardenable by the second hardening unit 40 in a second operational area 45 of the work surface 15. The first operational area 43 and the second operational area 45 are arranged one after the other along the rolling direction 37. In the second operational area 45, the lacquer was transferred to the work surface 15 and was partially hardened by the first hardening unit 39.

Similarly to the first hardening unit 39, the second hardening unit 40 is formed as a UV-light unit configured for at least partially hardening the lacquer in a contactless way by emitting UV-light. The second hardening unit 40 is arranged such that UV-light is emittable towards the work surface 15 in the second operational area 45 of the work surface 15 to at least partially harden the lacquer in the second operational area 45. However, the second hardening unit 40 may also be formed as an IR-light unit and be configured for at least partially hardening the lacquer in a contactless way by emitting IR-light. In this case, the second hardening unit 40 may be arranged such that IR-light is emittable towards the work surface 15 in the second operational area 45 of the work surface 15 to at least partially harden the lacquer in the second operational area 45. Alternatively, the second hardening unit 40 may also be formed as a fan heater unit configured for at least partially hardening the lacquer in a contactless way by emitting heated air. In case the second hardening unit 40 is formed as a fan heater unit, the second hardening unit 40 is arranged such that heated air is emittable towards the work surface 15 in the second operational area 45 of the work surface 15 to at least partially harden the lacquer in the second operational area 45.

When the transfer roller 27 rolls with the outer contact surface 33 on the work surface 15 of the workpiece 17 for transferring lacquer from the outer contact surface 33 and from the depressions to the work surface 15 of the workpiece 17 along the rolling direction 37, a first section of the lacquer is transferred to the work surface 15 in the first operational area 43. While the first section of the lacquer is transferred to the work surface 15 in the first operational area 43, the first section of the lacquer is partially hardened by the first hardening unit 39. While the transfer roller 27 rolls along the rolling direction 37, the first operational area 43 and the second operational area 45 both move together with the transfer roller 27 in the rolling direction 37 such that the first section of the lacquer passes from the first operational area 43 to the second operation area. In the second operational area 45, the first section of the lacquer is then at least partially hardened by the second hardening unit 40. Similarly, each section of the lacquer is transferred to the work surface 15 and partially hardened by the first hardening unit 39 in the first operational area 43, passed over from the first operational area 43 to the second operational area 45 and then at least partially hardened by the second hardening unit 40.

The device 13 in FIG. 2 comprises a shield 47 with an end section 49. The shield 47 is connected to the frame 21 and extends away from the frame 21 towards a distal end 51 of the end section 49 of the shield 47. The shield 47 is arranged between the first hardening unit 39 and the second hardening unit 40 such that the second operational area 45 is shielded from the UV-light emitted from the first hardening unit 39. The distal end 51 of the end section 49 of the shield 47 is arranged at a predefined distance from the work surface 15 when the transfer roller 27 rolls with the outer contact surface 33 on the work surface 15. Further, the end section 49 of the shield 47 is flexible such that the end section 49 is elastically deformable against the rolling direction 37.

In addition to the first hardening unit 39 and the second hardening unit 40, the device 13 may comprise a third hardening unit 44. The third hardening unit 44 may be configured for at least partially hardening the lacquer in a contactless way. The third hardening unit 44 may be arranged such that the lacquer is at least partially hardenable by the third hardening unit in a third operational area of the work surface 15 in which the lacquer was transferred to the work surface 15 and was partially hardened by the first hardening unit 39 and by the second hardening unit 40.

The device 13 shown in FIG. 2 can be used in a method for lacquer transfer. During this method, the transfer roller 27 rotates relative to the frame 21 about the axis of rotation 29. The drive unit 23 drives rotation of the transfer roller 27 about the axis of rotation 29. Lacquer is dispensed from the dispensing end 35 onto the outer contact surface 33 and into the depressions. The transfer roller 27 rolls with the outer contact surface 33 on the work surface 15 of the workpiece 17 along the rolling direction 37 such that the lacquer is transferred from the outer contact surface 33 and from the depressions to the work surface 15 in the first operational area 43 of the work surface 15. The lacquer is partially hardened in the first operational area 43 of the work surface 15 by UV-light emitted from the first hardening unit 39 towards the work surface 15 in the first operational area 43. While the transfer roller 27 rolls along the rolling direction 37, each section of the lacquer is transferred to the work surface 15 and partially hardened by the first hardening unit 39 in the first operational area 43, then passed over from the first operational area 43 to the second operational area 45, and then at least partially hardened by the second hardening unit 40 in the second operational area 45 of the work surface 15.

It is additionally pointed out that "comprising" does not rule out other elements, and "a" or "an" does not rule out a multiplicity. It is also pointed out that features that have been described with reference to one of the above exemplary embodiments may also be disclosed as in combination with other features of other exemplary embodiments described above. Reference signs in the claims are not to be regarded as restrictive.

While at least one exemplary embodiment is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A device for lacquer transfer, comprising:

a frame, a drive unit, a nozzle with a dispensing end for dispensing lacquer, a transfer roller with a circumferential lateral wall, and at least two hardening units comprising a first hardening unit and a second hardening unit, wherein the frame comprises a first extending arm, a second extending arm, and a third extending arm, wherein the nozzle is disposed at a distal end of the first extending arm, the first hardening unit is disposed at a distal end of the second extending arm, and the second hardening unit is disposed at a distal end of the third extending arm, wherein the transfer roller is rotatably mounted on the frame, such that the transfer roller is rotatable relative to the frame about an axis of rotation, wherein the drive unit is configured to drive rotation of the transfer roller about the axis of rotation, wherein a circumferential outer contact surface of the lateral wall comprises several depressions, wherein the nozzle and the transfer roller are arranged such that lacquer is dispensable from the dispensing end onto the outer contact surface and into the depressions when the transfer roller rotates about the axis of rotation, wherein the transfer roller is configured to roll with the outer contact surface on a work surface of a workpiece for transferring the lacquer from the outer contact surface and from the depressions to the work surface of the workpiece along a rolling direction, wherein the first hardening unit of the at least two hardening units is formed as a UV-light unit configured for partially hardening the lacquer in a contactless way by emitting UV-light, wherein the first hardening unit is arranged within an interior space defined by the transfer roller, wherein the lateral wall of the transfer roller is transparent for UV-light, wherein the first hardening unit is arranged such that UV-light is emittable towards the work surface in a first operational area of the work surface to partially harden the lacquer in the first operational area, wherein the lacquer is transferable to the work surface in the first operational area, wherein the second hardening unit of the at least two hardening units is configured for at least partially hardening the lacquer in a contactless way, wherein the second hardening unit is arranged such that the lacquer is at least partially hardenable by the second hardening unit in a second operational area of the work surface in which the lacquer was transferred to the work surface and was partially hardened by the first hardening unit.

2. The device according to claim 1, wherein the second hardening unit is formed as a UV-light unit configured for at least partially hardening the lacquer in a contactless way by emitting UV-light, wherein the second hardening unit is arranged such that UV-light is emittable towards the work surface in the second operational area of the work surface to at least partially harden the lacquer in the second operational area.

3. The device according to claim 1, wherein the second hardening unit is formed as an IR-light unit configured for at least partially hardening the lacquer in a contactless way by emitting IR-light, wherein the second hardening unit is arranged such that IR-light is emittable towards the work surface in the second operational area of the work surface to at least partially harden the lacquer in the second operational area.

4. The device according to claim 1, wherein the second hardening unit is formed as a fan heater unit configured for at least partially hardening the lacquer in a contactless way by emitting heated air, wherein the second hardening unit is arranged such that heated air is emittable towards the work surface in the second operational area of the work surface to at least partially harden the lacquer in the second operational area.

5. The device according to claim 1, further comprising a shield, wherein the shield is at least indirectly connected to the frame and extends away from the frame towards a distal end of an end section of the shield, wherein the shield is arranged between the first hardening unit and the second hardening unit such that the second operational area is shielded from the UV-light emitted from the first hardening unit.

6. The device according to claim 5, wherein the distal end of the end section of the shield is arranged at a predefined distance from the work surface when the transfer roller rolls with the outer contact surface on the work surface.

7. The device according to claim 5, wherein the end section of the shield is flexible such that the end section is elastically deformable against the rolling direction.

8. The device according to claim 1, wherein the device comprises a third hardening unit of the at least two hardening units, wherein the third hardening unit is configured for at least partially hardening the lacquer in a contactless way, wherein the third hardening unit is arranged such that the lacquer is at least partially hardenable by the third hardening unit in a third operational area of the work surface in which the lacquer was transferred to the work surface and was partially hardened by the first hardening unit and by the second hardening unit.

9. A method for lacquer transfer using the device according to claim 1, wherein the transfer roller rotates relative to the frame about the axis of rotation, the drive unit drives rotation of the transfer roller about the axis of rotation, lacquer is dispensed from the dispensing end onto the outer contact surface and into the depressions, the transfer roller rolls with the outer contact surface on the work surface of the workpiece along the rolling direction such that the lacquer is transferred from the outer contact surface and from the depressions to the work surface in the first operational area of the work surface, the lacquer is partially hardened in the first operational area of the work surface by UV-light emitted from the first hardening unit towards the work surface in the first operational area, and the lacquer is at least partially hardened in the second operational area of the work surface by the second hardening unit.

* * * * *